US007769338B2

(12) United States Patent
Ferrar et al.

(10) Patent No.: US 7,769,338 B2
(45) Date of Patent: Aug. 3, 2010

(54) ELECTROSTATOGRAPHIC APPARATUS HAVING IMPROVED TRANSPORT MEMBER

(75) Inventors: Wayne T. Ferrar, Fairport, NY (US); Douglas E. Garman, Webster, NY (US); Gary B. Bertram, Honeoye Falls, NY (US); Francisco L. Ziegelmuller, Penfield, NY (US); Patrick M. Lambert, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 828 days.

(21) Appl. No.: 11/557,838

(22) Filed: Nov. 8, 2006

(65) Prior Publication Data

US 2008/0107463 A1 May 8, 2008

(51) Int. Cl.
*G03G 15/00* (2006.01)

(52) U.S. Cl. ..... 399/400

(58) Field of Classification Search ..... 399/320, 399/322, 324, 400

See application file for complete search history.

(56) References Cited

U.S. PATENT DOCUMENTS

| | | | | |
|---|---|---|---|---|
| 4,780,356 | A | 10/1988 | Otouma et al. | |
| 4,879,166 | A | 11/1989 | Misuda et al. | |
| 5,085,698 | A | 2/1992 | Ma et al. | |
| 5,157,445 | A | 10/1992 | Shoji et al. | |
| 5,406,364 | A | 4/1995 | Maeyama et al. | |
| 5,512,409 | A | 4/1996 | Henry et al. | |
| 5,605,750 | A | 2/1997 | Romano et al. | |
| 5,693,442 | A | 12/1997 | Weiss et al. | |
| 5,723,211 | A | 3/1998 | Romano et al. | |
| 5,903,802 | A | 5/1999 | Watanabe et al. | |
| 7,120,380 | B2 | 10/2006 | Ferrar et al. | |
| 2005/0025540 | A1 * | 2/2005 | Murai et al. | 399/341 |
| 2006/0165974 | A1 | 7/2006 | Ferrar et al. | |

OTHER PUBLICATIONS

U.S. Appl. No. 11/359,067, filed Feb. 22, 2006; of Wayne T. Ferrar et al; titled "Electrostatographic Apparatus Having Improved Transport Member".

* cited by examiner

*Primary Examiner*—Hoang Ngo
(74) *Attorney, Agent, or Firm*—Carl F. Ruoff; Andrew J. Anderson

(57) ABSTRACT

The present invention is an electrostatographic reproduction apparatus which includes a primary imaging member for producing an electrostatic latent image on a receiver, a development station for applying toner particles to said latent image which forms a developed toner image on the receiver. A fuser assembly is included for fixing the developed toner image, to form a fused toner image on the receiver. A transport member is provided for transporting the receiver to or from the fuser assembly, the transport member having a substrate bearing an oil-absorbing layer that includes transparent alumina inorganic particles of gamma-alumina, dispersed in an organic binder.

21 Claims, 2 Drawing Sheets

ELECTROSTATOGRAPHIC APPARATUS HAVING IMPROVED TRANSPORT MEMBER

FIELD OF THE INVENTION

The present invention relates to electrostatographic image reproduction and, more particularly, to an electrostatographic apparatus that includes a transport web provided with a release oil-absorbing layer.

BACKGROUND OF THE INVENTION

Electrostatographic printers produce images by transferring polymeric toner particles from a photoreceptor to a receiver and fixing the toner particles to the receiver with heat and pressure. Various additives and oils are used to aid the transfer of the particles. Silicone oil is commonly used as a release oil because it is thermally stable and incompatible with the toner particles and other polymers in the printer; unfortunately, however, it tends to spread throughout the machine as prints are made. Release oil spread is exacerbated by duplex printing, which entails the application of images to both sides of a receiver sheet. Oil provided to the receiver during application of the first image on one side of a receiver is carried into the printer on the paper transport web in the course of applying the second image to the opposite side, leading to objectionable image artifacts such as non-uniform density and differences in gloss. Details of fuser oil application are given in U.S. Pat. Nos. 5,157,445 and 5,512,409, the disclosures of which are incorporated herein by reference.

Ink-jet printers produce images by ejecting droplets of ink onto receivers that absorb ink. Porous coatings of inorganic particles on the receivers improve the image quality by, for example, causing more rapid drying of the ink, reducing image spread, and producing more uniform ink coverage. Silica and alumina particles incorporated into binder polymers are used for coatings on paper and coatings on clear plastics such as polyethylene terephthalate sheets. While larger particles can be used to produce opaque coatings on paper substrates, smaller particles are required for coatings that are transparent in a binder, which is also desirably transparent and colorless. Microporous ink-jet recording elements prepared using psuedo-boehmite in organic polymer matrices are described in, for example, U.S. Pat. Nos. 5,723,211; 5,605,750; 5,085,698; 4,879,166; and 4,780,356, the disclosures of which are incorporated herein by reference.

Similar materials have also been used in electrophotography. U.S. Pat. No. 5,406,364 to Maeyama et al. describes a cleaner in the form of a web is prepared by immersing a piece of non-woven fabric into a colloidal solution of alumina or silica sol. Poly(vinyl alcohol) may also be added. The patent teaches that porous particles can absorb release agent to clean contaminated surfaces in an electrophotographic apparatus. There is no mention of transparency, or reference to the size of the oxide particles. The web is used to remove silicone oil from the transfer drum. The coating is subjected to repeated charging and discharging in the electrophotographic process and thus it does not have to possess insulating properties. Furthermore the material itself is not cleaned of toner from the electrophotographic process and, therefore, does not have to possess a low surface energy.

U.S. Pat. No. 5,903,802 to Watanabe uses pseudo-boehmite particles as well as silica particles, porous ceramics and foamed metals to clean transfer members and photoreceptors. Release agent absorbing layers are placed in various parts of the electrophotographic apparatus such as the feed passage member. Particle size is not important because there is no requirement for the layer to be transparent, nor is the coating subjected to repeated charging and discharging in the electrophotographic process. Furthermore the material itself is not cleaned of toner from the electrophotographic process and therefore does not have to possess a low surface energy.

Pseudo-boehmite coatings have also been applied to the photoreceptors used in electrophotographic printing. U.S. Pat. No. 5,693,442, the disclosure of which is incorporated herein by reference, describes the incorporation of a nickel metallized dye into an overcoat of pseudo-boehmite to act as a filter to protect the light sensitive element. The inorganic particles and 5 wt. % of the metallized dye in a poly(vinylpyrrolidone) binder form a transparent layer that can be charged under a corona charger and discharged by exposure to actinide radiation.

Pseudo-boehmite is disclosed as an oil absorbing layer that employs fluorinated surfactants as cleaning aids in U.S. Pat. No. 7,120,380. Pseudo-boehmite is disclosed as in a transport member for an electrophotographic apparatus that displays high friction in U.S. Patent Publication No. 2006/0165974. Pseudo-boehmite is disclosed as an oil absorbing layer that employs wax overcoats as cleaning aids in U.S. application Ser. No. 11/359,067. All three of these are incorporated by reference into this application.

The mitigation of objectionable image artifacts such as non-uniform density and differences in gloss that result from the spread of release oil from an imaged receiver into the reproduction apparatus, particularly during a duplex printing process, is provided by the present invention.

SUMMARY OF THE INVENTION

The present invention is an electrostatographic reproduction apparatus which includes a primary imaging member for producing an electrostatic latent image, a development station for applying toner particles to said latent image which forms a developed toner image. A fuser assembly is included for fixing the developed toner image to a receiver, to form a fused toner image on the receiver. An endless transport member is provided for transporting the receiver to or from the fuser assembly, the transport member having a substrate bearing an oil-absorbing layer that includes transparent alumina inorganic particles of gamma-alumina, dispersed in an organic binder.

For a better understanding of the present invention together with other advantages and capabilities thereof, reference is made to the following description and appended claims in connection with the preceding drawings.

DETAILED DESCRIPTION OF THE INVENTION

Figure 1:
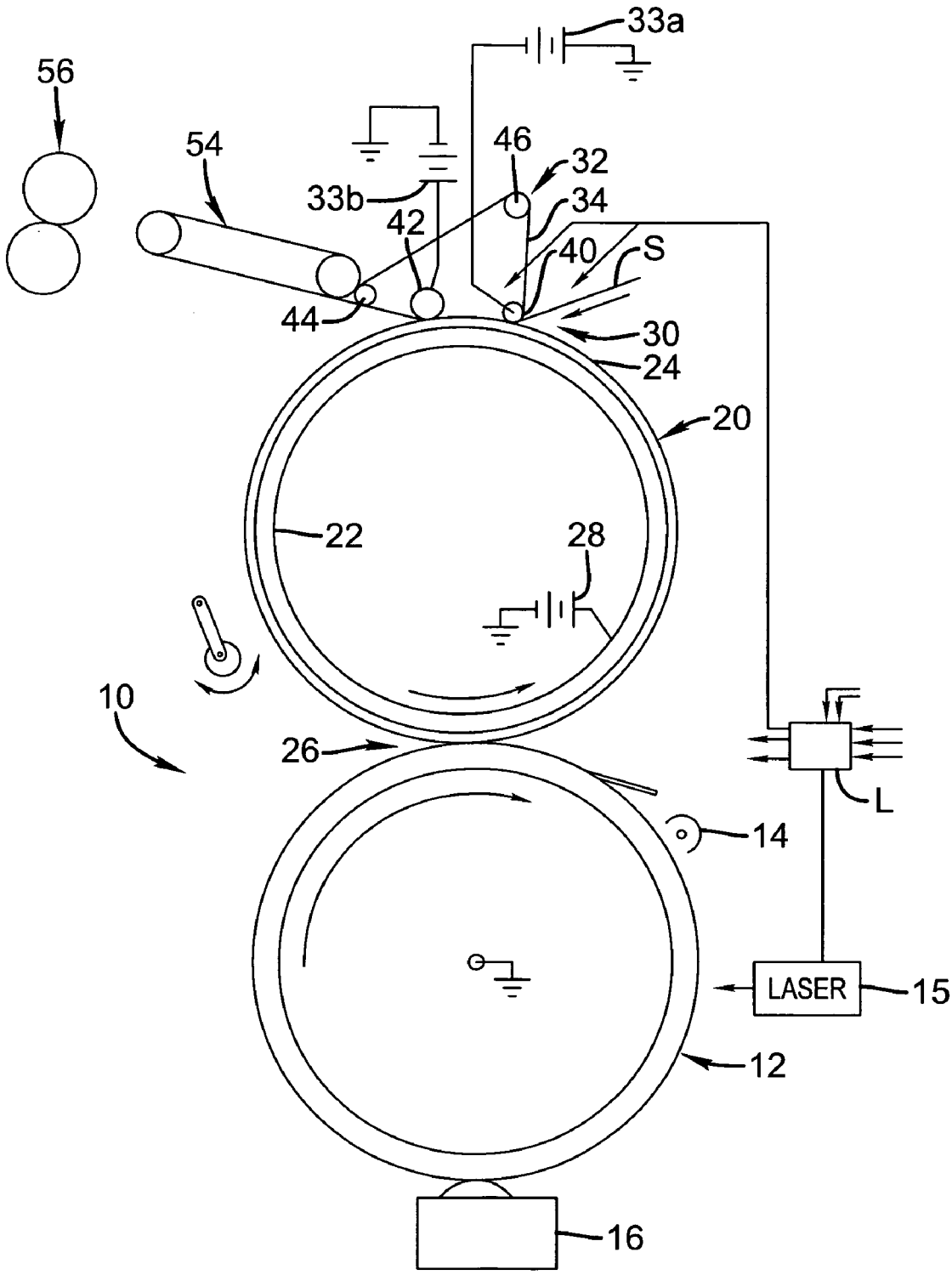
FIG. 1 is a schematic side elevational view of an electrostatographic reproduction apparatus that includes an endless web transport member for moving a receiver to and from a fuser assembly.

FIG. 1 shows an exemplary image-forming electrostatographic reproduction apparatus, designated generally by the numeral 10, that includes a primary image-forming member, for example, a drum 12 having a photoconductive surface, upon which a pigmented marking particle image, or a series of different color marking particle images, is formed. To form images, the outer surface of drum 12 is uniformly charged by a primary charger such as a corona charging device 14, and the uniformly charged surface is exposed by suitable exposure device such as a laser 15 to selectively alter the charge on the surface of the drum 12, thereby creating an electrostatic image corresponding to an image to be reproduced. The electrostatic image is developed by application of pigmented marking particles to the image bearing photoconductive drum 12 by a development station 16 that may include from one to four (or more) separate developing devices.

The marking particle image is transferred (or multiple marking particle images are transferred one after another in registration) to the outer surface of a secondary or intermediate image transfer member, for example, an intermediate transfer drum 20 that includes a metallic conductive core 22 and a compliant layer 24 that has relatively low resistivity. With such a relatively conductive intermediate image transfer member drum 20, transfer of the single color marking particle images to the surface of drum 20 can be accomplished with a relatively narrow nip 26 and a relatively modest potential applied by potential source 28.

A single marking particle image, or a multicolor image comprising multiple marking particle images respectively formed on the surface of the intermediate image transfer member drum 20, is transferred in a single step to a receiver S, which is fed into a nip 30 between intermediate image transfer member drum 20 and a transfer backing member 32. The receiver S is fed from a suitable receiver member supply (not shown) into nip 30, where it receives the marking particle image. Receiver S, exits nip 30 and is transported by a transport web 54 to a fuser assembly 56, where the marking particle image is fixed to receiver S by application of heat and/or pressure. Receiver member S bearing the fused image is transported by transport web 54 to a storage location (not shown) or is inverted by a mechanism (not shown) for transfer of a second image to the reverse side of receiver S.

A transfer-backing member 32 that includes an endless support 34 is entrained about a plurality of support members, for example rollers 40, 42, 44, and 46. Support roller 42 is electrically biased by potential source **33*b* to a level sufficient to efficiently urge transfer of marking particle images from intermediate image transfer member drum 20 to receiver member S. At the same time, support roller 40 is electrically biased, for example to ground potential, or electrically connected to source 28 or a separate potential source 33*a*, to a level sufficient to eliminate ionization and premature transfer upstream of nip 30**.

Appropriate sensors (not shown) of any well known type are utilized in reproduction apparatus 10 to provide control signals for apparatus 10, which are fed as input information to a logic and control unit L that produces signals for controlling the timing operation of the various electrographic process stations.

To facilitate release of the fixed toner image from fuser assembly 56, a release agent such as silicone oil is applied to imaged receiver S by a mechanism such as depicted in FIG. 1 of the previously cited U.S. Pat. No. 5,157,445. As already noted, an excess of this oil can be carried to other parts of apparatus 10, especially in the course of duplex printing, resulting in objectionable image artifacts.

In accordance with the present invention, a transport member in an electrostatographic reproduction apparatus 10, depicted in FIG. 1, includes a release oil-absorbing layer disposed on a substrate. Although the transport member is exemplified as a continuous web 54 in FIG. 1, it may take other forms such as, for example, a drum or roller. Apparatus 10 further includes a primary image-forming member, which is exemplified in FIG. 1 as a drum 12 but may be constructed in another form such as, for example, a roller or a belt. The reproduction apparatus optionally includes, operationally associated with the primary image-forming member, an intermediate image transfer member, which is depicted in FIG. 1 as a drum 20 but may also be constructed in another form such as, for example, a roller or a belt.

A transport member provided with an oil-absorbing layer in accordance with the present invention may be included in a full color reproduction apparatus having four toner development stations for cyan, magenta, yellow, and black, as depicted in FIG. 8 of U.S. Pat. No. 6,075,965, the disclosure of which is incorporated herein by reference. A developed multicolor image, following fixing by a fuser assembly, can be transported to a storage site or circulated back for recording an image on the opposite side of the receiver, as described in U.S. Pat. No. 6,184,911, the disclosure of which is incorporated herein by reference.

Charge is repeatedly applied to the surface of the transport member in every imaging cycle at each of the transfer nips. The transport web is reconditioned in each cycle by providing charge to both surfaces by opposed corona chargers 522, 523 in FIG. 8 of U.S. Pat. No. 6,075,965. An additional corona charger 524 provides negative charge of approximately 600-900 V to tack down of the paper or receiver to the transport web thus preventing the receiver from moving as it goes through the electrophotographic process. After transfer of the toner image to the receiver, the receiver is conveyed on the transport web to a nip where an electrical bias is applied so the receiver can be detacked and fed into a fuser station. Additionally the web is imaged with various colored toners that are used for process control of image density and registration. Thus, it is important that the transport member have insulating properties that allow for efficient charging and for the maintenance of the charge throughout the electrophotographic cycle. If the resistivity of the transport member decreases due to high humidity, the image quality of the process is compromised. In general poly(ethylene terephthalate) is one of the preferred substrates for the transport member because it has a good insulating properties. It would be desirable that any coating on the transport member maintain similar insulating properties.

It is also important that the layer be transparent or translucent so that sensors for process control can be used to monitor toner density and image registration. These sensors can work by passing light through the coated transport web to a detector on the opposite side or by reflecting the light back to a detector mounted above the sensor. The light may be reflected by a separate reflector after the light has passed through the web, or by the support itself.

Previous inventions for release oil absorbing layers employed pseudo-boehmite particles. Pseudo-boehmite a xerogel of boehmite and is represented by the chemical formula Al(O)OH. It is a crystalline solid with the boehmite X-ray diffraction pattern. Pseudo-boehmite is a highly hydrated form of alumina and contains a large amount of water, which makes it a poor electrical insulator. It is easily dispersed in water from which it can be coated onto a support with poly(vinyl alcohol) as a binder.

A more condensed form of pseudo-boehmite is gamma-alumina.

Gamma-alumina is a crystalline phase of aluminum oxide that can be prepared by heating pseudo-boehmite to 500-550° C. for three hours. It is used as a filler particle in silicone polymers and as a catalyst for petroleum refining and in automobiles. In this invention we incorporate gamma-alumina into a transparent layer to absorb silicone release fluid in a electrophotographic printer where the release fluid comes from the fuser. The gamma-alumina can be dispersed in organic solvents by milling techniques and coated with binder polymers such as poly(vinyl butyral) onto various supports. These coatings have the advantage over porous layers made from using pseudo-boehmite particles because they display a higher electrical resistivity, even at high humidity. The transparent, porous coatings made with the gamma-alumina will thus hold a charge that is deposited by a corona or roller charger for a longer period of time, allowing for improved tackdown of an electrophotographic receiver and more efficient transfer of toner particles for imaging. Additionally, these porous coatings with the gamma-alumina and an organic binder can be overcoated with wax that melts below 100 C to produce a layer that has lower surface energy for removal of toner during cleaning. We also show below that the gamma-alumina particles and coatings can be modified with poly(siloxanes) to further increase the resistivity to allow for better receiver tack down and facilitate toner removal after the charge is removed from the coating.

The gamma-alumina inorganic particles are represented by the chemical formula $Al_2O_3$. Literature reference to gamma-alumina include K. Sohlberg, S. J. Pennycook, and S. T. Pantelides, J. Am. Chem. Soc. 1999, 121, 7493-7499 and J. Temuujin, Ts Jadambaa, K. J. K. MacKenzie, P. Angerrer, F. Porte, and F. Riley, Bull. Mater. Sci, Vol. 23, No. 4, August 2000, pp[. 301-304. The pore characteristics of the gamma-alumina vary depending upon the size and shape of the particles. The particle size is determined by the effectiveness of breaking up the agglomerates to form the primary particle size. Calcining of a pseudo-boehmite particle at 500 C for 3 hours forms gamma-alumina crystallites that are smaller in size but have higher pore volumes than the pseudo-boehmite precursors. Larger particles scatter light to various degrees and thus it is an advantage to use a smaller particle that also produces high porosity coatings. Comparing gamma-alumina particles, smaller particles have smaller pores than the larger particles and tend to be transparent. Smaller particles with a dispersed particle size of less than 0.5 micron are used for this invention so the porous layers are transparent or translucent. More preferably, the dispersed particle size is less than 0.3 microns. Most preferably, the dispersed particle size is less than 0.1 microns.

Gamma-alumina is a better insulator than pseudo-boehmite. Calcining the particles from the pseudo-boehmite form to the gamma-alumina form drives off much of the water within the pseudo-boehmite structure. Psuedo-boehmite has a formula of AlO(OH), reflecting a high water content, while gamma-alumina can be more closely represented by the general alumina formula of $Al_2O_3$. High purity of the gamma-alumina is also important to achieve good resistivity of the oil absorbing layer, which can be reflected in the process used to make the pseudo-boehmite. Gamma-alumina also has higher porosity than pseudo-boehmite. Thus coatings can be thinner, using less material and causing less stress in the coating that could result in cracking and delamination. Coating made with 10 microns of gamma-alumina/poly(vinyl butyral) absorb about the same amount of silicone release fluid as 20 micron coatings of pseudo-boehmite/PVA.

An organic binder is employed in the oil-absorbing layer to impart mechanical strength to it. The pore characteristics and transparency of the oil-absorbing layer depend on the particular binder employed. Suitable binders include organic materials such as, for example, starch or one of its modified products, poly(vinyl alcohol) or one of its modified products, cellulose derivatives, ether-substituted poly(phosphazenes), ether-substituted acrylates, ethylene oxide-vinyl alcohol copolymers, poly(vinyl butyral) (PVB), poly(vinyl formal), polyoxazolines, aliphatic polyamides, and poly(vinylpyrrolidone). A major factor in the choice of the binder is that it is compatible with porous alumina particles and results in a transparent or translucent layer. The binder, preferably poly (vinyl butyral), is present in an amount, based on the amount of inorganic particles, of preferably about 3 wt. % to about 30 wt. %, more preferably, about 5 wt. % to about 25 wt. %. If the amount of binder is less than about 3 wt. %, the strength of the oil-absorbing layer tends to be inadequate. On the other hand, if it exceeds 30 wt. %, its porosity tends to be inadequate. Coatings made of the dispersed gamma-alumina of less than 0.5 micron dispersed particle size on transparent substrates are clear to translucent, and therefore allow for the process control sensors to operate effectively. Poly(vinyl butyral) has fewer hydroxyl groups on the polymer than poly(vinyl alcohol) because they have been substituted with a butyl group, making the polymer less polar. In general, poly(vinyl butyral)s are soluble in alcohol and organic solvents but are insoluble in water.

The coatings prepared with gamma-alumina are inherently more insulting than those made with pseudo-boehmite. As discussed above, the gamma-alumina particles are inherently more resistive than the pseudo-boehmite particles. Correspondingly gamma-alumina sols are prepared by milling in organic solvents such as ethanol or 1-methyl-2-propanone, but unlike pseudo-boehmite they are not water dispersible. Poly(vinyl butyrals) are soluble in organic solvents and we have found that these binders generally stabilize the gamma-alumina sols in ethanol or 3A alcohol to allow for transparent coatings. The coatings have resistivities approaching $10^{12}$ ohm/sq at 70° F./60% RH, which is approximately 2 orders of magnitude more resistive than similar coatings made with pseudo-boehmite and poly(vinyl alcohol) coated from water. It is preferable to have coated transport webs made with gamma-alumina and poly(vinyl butyral) that have resistivities with a minimum resistivity equal to or greater than $1\times10^{11}$ ohm/sq at 70° F./60% RH.

The release oil-absorbing layer of the present invention preferably has a dried thickness of about 1 μm to about 40 μm, more preferably, about 2 μm to about 30 μm, and most preferably between 4 and 20 μm. The release oil absorbing layers of gamma-alumina/PVB are more efficient than the pseudo-boehmite/PVA layers of the previous work, allowing for thinner layers to absorb the same amount of oil. This is possible because of a significant improvement in the oil absorption capacity when compared to pseudo-boehmite/PVA layers. Optionally, the oil-absorbing layer can also incorporate various known additives, including surfactants, pH controllers, anti-foaming agents, lubricants, preservatives, viscosity modifiers, waterproofing agents, dispersing agents, UV absorbing agents, mildew-proofing agents, mordants, crosslinking agents such as boric acid or borax, and the like, with the proviso that the additive does not greatly decrease resistivity or the transparency of the layer. The oil-absorbing layer can also include matting agents such as matte beads comprising crosslinked polystyrene, crosslinked polyacrylate, or polytetrafluoroethylene (TEFLON™) and having a diameter preferably between about 1 μm and about 30 μm, more preferably between about 2 μm and about 10 μm.

A web substrate for the oil-absorbing layer can be reflective, translucent, or transparent and can have a thickness of, preferably about 50 μm to about 500 μm, more preferably, about 75 μm to about 300 μm. The web substrate must either allow light to pass through or be reflective. Poly(ethylene terephthalate) (PET) is a preferred substrate. Other clear semi-crystalline substrates such as poly(ethylene naphthalate) (PEN) are also thought to be useful. Antioxidants, antistatic agents, plasticizers, and other known additives may be optionally incorporated in the web substrate.

The adhesion of the oil-absorbing layer to the substrate can be improved by corona-discharge treatment of the substrate surface prior to application of the oil-absorbing layer. Alternatively, an undercoating or subbing layer formed from a halogenated phenol or a partially hydrolyzed vinyl chloride-vinyl acetate copolymer and having a thickness (i.e. a dry coat thickness) preferably of less than 2 μm can be applied to the surface of the substrate.

Optionally, an additional backing layer or coating may be applied to the backside of the web substrate, i.e., the side of the substrate opposite the side bearing the oil-absorbing layer, to improve the machine-handling properties of the transport web and controlling the friction and resistivity thereof. Typically, the backing layer includes a binder and a filler, which can be, for example, amorphous and crystalline silicas, poly (methylmethacrylate), hollow sphere polystyrene beads, microcrystalline cellulose, zinc oxide, talc and the like. The filler included in the backing layer is generally less than 2 wt. % of the binder, and the average particle size of the filler material is in the range of 5 μm to 15 μm. Typical of the binders used in the backing layer are polymeric materials such as gelatin, chitosan, acrylates, methacrylates, polystyrenes, acrylamides, poly(vinyl alcohol), poly(vinylpyrrolidone), poly(vinyl chloride)-co-poly(vinylacetate), SBR latex, NBR latex, and cellulose derivatives.

To form the release oil-absorbing layer on a substrate, a binder is added to the inorganic particles to obtain a slurry, which is coated on the substrate using, for example, a roll coater, an air knife coater, a blade coater, a rod coater, a bar coater, or a comma coater, and then dried. Preferred coating compositions for the oil-absorbing layer contain gamma-alumina and poly(vinyl butyral) in a weight ratio of about 3:1 to about 20:1.

The present invention also provides a method to eliminate slippage of the intermediate transfer drum against the transport web and thus provides for improved registration of a composite image. However it is not meant to limit these improvements only to these elements in an electrostatographic printer, and could include suppression of slippage between a photoreceptor drum or belt. According to this invention, a frictionally driven electrostatographic reproduction apparatus has a receiver member transport web element that is frictionally coupled with each module that produces a toned color separation image, preferably a dry toned image, and a fuser assembly with a fuser release agent for fixing developed toner images to form a fused toner image on a receiver member. The receiver member transport web is formed so as to include a substrate and a layer that contains inorganic particles of gamma-alumina dispersed in an organic binder to form a porous layer. The previous U.S. patent application Ser. No. 11/359,067 described the inorganic particles as pseudo-boehmite, an agglomerated crystalline inorganic sub-oxide that takes the form of plates and needles. This invention extends those advantages from the previous invention, with all of the added benefits of the transparent coating obtained from gamma-alumina/poly(vinyl butyral), including higher resistivity and higher oil absorption.

Some of the previous inventions described the addition of the fluorosurfactant ZONYL™ FSN to aid in cleaning of toner from the transport web surface. However, ZONYL™ FSN is composed from ethylene glycol with a fluorocarbon, and when this surfactant is combined with pseudo-boehmite and poly(vinyl alcohol), the resistivity of the coating has been found to decrease especially at high humidity. This results in a number of undesirable properties such as poor tack down of the paper or receiver to the transport web because the conductive ZONYL™ FSN surfactant provides a pathway for the charge to dissipate. The charge was deliberately place on the web by the web charger in order to hold the receiver in place and allow for imaging with toner for process control purposes and an image with poor quality can result from the charge dissipation.

WE waxes are fatty acid esters formed from long chain fatty acid and alcohols produced by NOF Corporation of Japan. They are high purity solids characterized by narrow melting ranges, low endothermic energy for melting, and high thermostability. The WE waxes useful for this invention have melting points below 100° C., which is below the 120° C. temperature used to dry the films in the coating process. Thus the waxes do not block the pores of the pseudo-boehmite because the films are dried above the melting points of the waxes. The waxes can be made into aqueous emulsions or are soluble in organic solvents. This means the waxes can be coated over the top of the gamma-alumina porous layer in a separate step. Wax overcoated coatings have resistivities approaching $10^{13}$ ohm/sq at 70° F./60% RH, which is approximately 3 orders of magnitude more resistive than similar coatings made with pseudo-boehmite and poly(vinyl alcohol) coated from water. It is more preferable to have coated transport webs made with gamma-alumina and poly (vinyl butyral) that have resistivities with a minimum resistivity equal to or greater than $1\times10^{12}$ ohm/sq at 70° F./60% RH.

Figure 2:
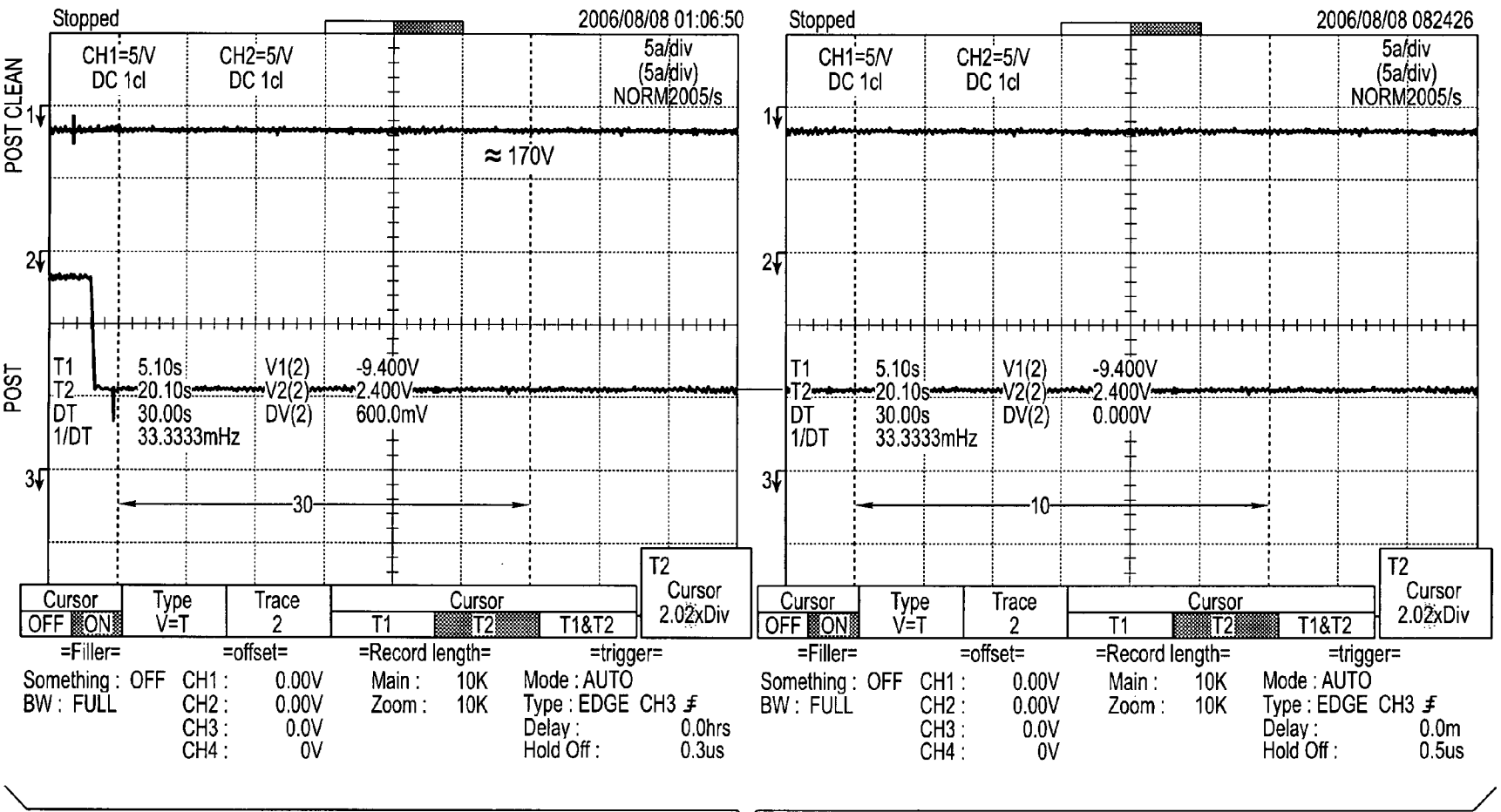
FIG. 2 is a plot of the voltage decay of the gamma-alumina/poly(vinyl butyral)/siloxane overcoated transport web.

We have now found that siloxane polymers are useful to increase the resistivity of the gamma-alumina/poly(vinyl butyral) oil absorbing layer, and also act as lubricants that make cleaning of the layer more efficient. In general low molecular weight PDMS will make the layer substantially more resistive, to the point where it is similar to the PET substrate. For example, 10 micron coatings have been prepared with surface resistivities between $10^{13}$ and $10^{15}$ ohm/sq at 70° F./60% RH. This results in an important advantage of good paper or receiver tack down, even after several minutes of machine stoppage. The stable electrical properties of the gamma-alumina with the poly(vinyl butyral) binder and PDMS is depicted in FIG. 2. It is most preferable to have coated transport webs made with gamma-alumina, poly(vinyl butyral), and PDMS that have resistivities with a minimum resistivity equal to or greater than $1\times10^{13}$ ohm/sq at 70° F./60% RH.

The voltage diagrams in FIG. 2 replicate those for PET. There is no significant decay, even after 10 minutes at rest. This results in good receiver tack-down to the transport web with coated and uncoated paper, and has a minimal threat of wrapping during a paper purge.

It is particularly advantageous to add the siloxane to the coating solution before it is milled. This results in a uniform distribution of the siloxane and good coating quality. Hydroxy terminated PDMS appears to be particularly useful to prepare good coating, possible because the hydroxyl groups interact or even condense on the surface of the gamma-alumina. The level of PDMS can be relatively high, with concentrations greater than 10 wt % of the coating solid. But it is even more surprising that the pore volume of the coated layer as measured by oil uptake of fuser oil increases when PDMS is added to the formulation. In contrast, the addition of fluorosurfactants such as Zonyl™-FSN causes the oil absorption volume to decrease. The PDMS also aids in cleaning of the coating of toner that is deposited during color and receiver registration as part of the electrophotographic process control.

It is also possible to generate PDMS polymers in-situ by adding alkoxysilanes to the coating solution. The addition of dimethyldimethoxysilane to the ethanol coating solution leads to the formation of siloxane segments in the coating that also increase the resistivity and improve the cleaning properties. At low humidity the porous layer is dry and has high resistivity. This allows for easy charging of the transport web and results in good paper tack down and good image registration and process control from imaging on the transport web. Measurement of the surface resistivity of the porous layer gives a good indication of how well the coated transport webs will hold a charge. The surface resistivity can be measured using a Keithley electrometer. A 10 micron thick coating of the gamma-alumina/poly(vinyl butyral) over the PET transport web had surface resistivity in the $10^{12}$ ohm/sq at range that did not change more than an order of magnitude between 20-60% RH. Thus these coatings are approximately two order of magnitude more resistive than comparable pseudo-boehmite/PVA oil absorbing layers. Addition of up to 10 wt % of dihydroxy terminated poly(dimethylsiloxane) further increases the resistivity of the film into the $10^{14}$ ohm/sq range. In fact, these films are now such good insulators that the resistivity readings are comparable to those obtained for PET, and are probably at the limit of the range measurable with the Keithley electrometer.

It was our intention to combine the use of PDMS and WE waxes in the gamma-alumina layers to obtain high resitivity and good cleaning of the porous surface. However, we have found it is difficult to deposit the wax overcoats on materials that have PDMS incorporated in the initial layer. Thus this limits the use of the wax overcoats to alumina/poly(vinyl butyral) layers that contain low levels of PDMS. We found that overcoating layers with 10 wt % PDMS incorporated resulted in spotty coatings with areas with and without wax overcoat.

Siloxanes are also useful as overcoats for the oil absorbing layer. They provide another layer of protection against moisture that might lower the resistivity at high relative humidity, and they help facilitate cleaning of toner by the cleaning blade. The siloxanes lower the surface energy of the alumina layer and act as lubricants. The siloxane overcoats do not interfere with oil absorption, nor do they cause image artifacts on prints from the electrophotographic printers. They can be coated from a number of environmentally acceptable solvents. We have found that ethanol can be used to form an overcoat of low molecular weight dihydroxy PDMS, viscosity of 20-35 centistokes. Higher molecular weight PDMS of 10,000 centistoke and without hydroxyl groups can be prepared from 2-butanone. Surface resitivities as high as $10^{15}$ ohm/sq at 60% RH have been obtained in the films with high amounts of PDMS. However, attempts to use 100,000 centistoke PDMS resulted in slippage of the transport web in the printer, probably due to transfer of the PDMS to the back surface when the web was rolled upon itself.

Another useful method to examine the surface of a coating is the use of fluids to determine the surface energies. This technique involves placing a drop of a non-interacting fluid on the sample and measuring the angle between the surface of the drop and the surface of the sample. A low contact angle indicates a high surface energy because the fluid has spread. Conversely a high contact angle indicates that the sample has a low surface energy because the fluid has formed a bead. One would expect that a good analogy for wax on the pseudo-boehmite surface would be the formation of rain drops on a freshly waxed car, with a high contact angle being observed by placing a drop of water on the coating. While in some sense this is true, the observation is complicated by the fact that the gamma-alumina surface is porous and maintains that porosity after the wax is placed on the surface and melted into the pores in the coating machine dryers. Making the measurement is difficult because the drop is rapidly absorbed into the coating and the contact angle changes rapidly with time. Additionally the surfaces of these coatings are relatively rough as compared to PET, preventing the drops from obtaining an equilibrium position. When printing duplex images on certain described reproduction apparatus, release oil that had been applied to an imaged receiver transfers to the transport web from sheets that are to be printed on the second side. Comparison measurements of oil concentrations as a function of duplex run lengths have been carried out on standard uncoated paper transport webs and on webs provided with an oil-absorbing layer in accordance with the present invention. The oil-absorbing coating provides protection from oil artifacts by drawing oil into the porous interior of the coating, reducing the amount of oil available at the surface for transfer to other parts of the machine. On the basis of this mechanism, the useful life of a web would depend on the oil capacity of the coating, which would be expected to depend on the coating thickness. The effective lifetime of a coating can be predicted based on its estimated capacity and the measured oil take up rate. A gamma-alumina/poly(vinyl butyral) transport web provided protection against oil streaks on image flat field after almost 4000 A4 equivalent prints. Previous experiments with pseudo-boehmite showed the experiment could have continued much longer. An uncoated web shows the fuser oil stripe signature after 18 prints.

In conclusion, important properties of the gamma-alumina/poly(vinyl butyral) transport webs include:

High resistivity to prevent charge from bleeding from the surface and decreasing the tackdown force of the receiver to the web ($10^{10}$ to $10^{15}$ ohms/sq).

High porosity for the absorption of the fuser fluid from the receiver to prevent the fluid from spreading to other components and causing image artifacts (200 to 600 $mg/m^2/\mu m$).

Good mechanical properties that produce long life coatings with no powder or dusting.

Improved registration of a composite image by the elimination of slippage of the intermediate transport drum against the transport web.

The present invention is further illustrated by the following examples, but it should be understood that the invention is not in any way restricted to such examples.

EXAMPLES

Pseudo-boehmite particles were obtained from Sasol North America, Inc of Houston, Tex. under the trade name of DISPAL™ 18N4-80. The pseudo-boehmite was converted to gamma-alumina by heating the particles in a furnace at 500° C. for 3 hours. The loss of water caused a reduction in weight of about 20-30%. Full conversion of the pseudo-boehmite to gamma-alumina was monitored by X-ray diffraction. Subsequent heating of partially converted material resulted in pure gamma-alumina. However oil absorbing layers with good resistivity and oil absorption were also prepared from partially converted gamma-alumina. The particle size of the gamma-alumina was determined by X-ray diffraction to be about 100 angstroms or less based on the x-ray line broadening analysis of the gamma-alumina (440) peak, while the pseudo-boehmite was 126 angstroms based on the (120) peak.

A general procedure for the coating formulation is described here. The gamma-alumina was roll milled in 3A-alcohol at 20% solids for 5 days using 2 micron zirconia or 1.8 micron yttria doped zirconia beads. Alternatively, 3 mm stainless steel shot was used as the milling media, but this discolored to give a gray tint. The beads were filtered off using a stainless steel screen, the alumina dispersion was filtered using a 40 micron Pall filter. The poly(vinyl butyral) binder and optionally the silanol terminated poly(dimthysiloxane) was added to the dispersion before placing it through a Netzsch LabStar superfine grinding mill employing 1.0 micron yttria doped zirconia beads as the grinding material. Typically 1 liter of solution at 14% solids was milled for 1 hour. Additional binder or siloxane was sometimes added, and then the dispersion was then filtered through a 10 micron Pall filter. The silanol terminated poly(dimethylsiloxane) was DMS-S12, molecular weight from 400-700, viscosity 16-32 centistoke, from Gelest, Inc. Tullytown, Pa., USA. Poly(vinyl butyral) was BH-6 ($9.2\times10^4$ molecular weight; 69+/−3 mole % butyral content) was obtained from Sekisui Products LLC, Troy, Mich., and Butvar™ B-72 (170,000-250,000 weight average molecular weight, 80% butyral content) from Solutia, St. Louis, Mo., USA. WE-5 fatty acid ester was obtained from NOF Corporation, Japan through Nagase America Corporation, New York, N.Y. as an aqueous dispersion and diluted to 1 wt % by the addition of deionized water. WE-6 was obtained from the some source as pellets and dissolved in dichloromethane as a coating solvent.

The white gamma-alumina dispersion was coated, using an extrusion hopper, over a subbing layer of acrylonitrile-vinyl chloride-acrylic acid on one side of a 102 μm-thick polyethylene terephthalate film and dried at temperatures up to 120° C. for 20-30 minutes. The coatings were flexible, clear, transparent films that were formed into loops by ultrasonic sealing with the coating on the outside of the loop with an ultrasonic horn.

Web voltage readings are taken by placing an electrometer on the web after it has been charged to tack down the receiver. The current Nexpress PET transport web has 750 Volts remaining on the web after 30 seconds. Receiver Tack Down readings are obtained by stopping the Nexpress 2100 printer immediately after paper has been tacked down on the web, and pulling on the paper in a tangential direction to remove it from the web. A Receiver Tack Down value of 10 is assigned for the amount of force to remove the receiver from the P1 web. Values for the pseudo-boehmite coated webs are compared to the P1 web by estimating the amount of force needed to remove the receiver from the web. The receiver is 118 gram LustroGloss. A polyurethane blade is used to clean the toner from the porous layer.

Comparative Example 1

Pseudo-boehmite/PVA/Zonyl-FSN®

The preparation of this pseudo-boehmite/PVA (9/1) coating and 6 parts Zonyl-FSN® was prepared as follows. Pseudo-boehmite particles were obtained from Sasol North America, Inc of Houston, Tex. under the trade name of DISPAL™ 18N4-80. The particles had a dispersed particle size of 110 nanometers. A 25 wt. % pseudo-boehmite dispersion was prepared from 90 g of DISPAL™ 18N4-80 alumina particles to 270 g of stirred deionized water. A 10 wt. % poly(vinyl alcohol) solution was prepared in a ratio of 10 g poly(vinyl alcohol) powder (KH-20 GOHSENOL™, Nippon Gohset) to 90 g stirred deionized water, and heating the mixture to 80° C. for 1 hour to produce a clear, viscous solution. The solutions were mixed and the appropriate amount of ZONYL™ FSN surfactant (40 wt. % active in isopropanol/water) was added as a coating aid (0.01 to 0.02 wt. %) or at various increments up to 6 parts by weight of the solid (5.7 wt. %).

Comparative Example 2

WE-6 wax overcoat on pseudo-boehmite/PVA. The preparation of pseudo-boehmite/PVA (9/1) coating as described in Comparative Example 1 was overcoated with the WE-6 polyester wax from dichloromethane.

Comparative Example 3

A NexPress 2100 transport web made of 4 mil PET.

Examples 1 and 2

Gamma-alumina/poly(vinyl butyral). Gamma-alumina (100 g), 3 A alcohol (400 g), and 1.8 mm zirconia beads (1600 g) was placed in a 32 oz. jar and roll milled for 4 days. The alumina was collected by filtering off the shot and rinsing with 3A-alcohol (200 g) to give a 14.3% solids dispersion. To this alumina dispersion (564 g), the poly(vinyl butyral) BH-6 (89.6 g of a 10 wt % solution in 3A-alcohol was added to give a formulation with 9/1 by weight of alumina/poly(vinyl butyral). The solution was Netsch milled for 1 h, then filtered 200 mesh inline filter followed by filtration through a 10 micron Pall filter. The solution was coated onto a PET support as described for pseudo-boehmite/PVA in U.S. application Ser. No. 11/359,067 to give Examples 1 (10 micron coating) and Example 2 (15 micron coating).

Example 3

WE-5 wax overcoat on gamma-alumina/poly(vinyl butyral). Gamma-alumina (250 g), 3-A alcohol (1000 g), and 2.0 mm zirconia beads (5000 g) was placed in a 1 gallon jar and roll milled for 5 days. The alumina was collected by filtering off the shot and rinsing with 3A-alcohol (500 g) and pumped through a 40 micron Pall™ filter to give a 14.3% solids dispersion. To this alumina dispersion (1618 g), the poly(vinyl butyral) BH-6 (257 g of a 10 wt % solution in 3A-alcohol) was added to give a formulation with 9/1 by weight of alumina/poly(vinyl butyral). The solution was Netsch milled for 3 h, followed by filtration through a 10 micron Pall filter. The solution was coated onto a PET support as described for Example 1 above.

The alumina layer was overcoated with a 1% aqueous solution of WE-5 fatty acid ester to give a 0.1 micron overcoat of wax.

Example 4

WE-5 wax overcoat on gamma-alumina/poly(vinyl butyral). The same procedures were followed as for Example 3 except the overcoat thickness was increased to 0.25 microns.

Example 5

16 parts hydroxy terminated PDMS added to 92 wt % gamma-alumina and 8 wt % poly(vinyl butyral) binder. Gamma-alumina (250 g), 3 A alcohol (1000 g), and 2.0 mm zirconia beads (5000 g) was placed in a 1 gallon jar and roll milled for 5 days. The alumina was collected by filtering off the shot and rinsing with 3A-alcohol (500 g) and pumped through a 40 micron Pall™ filter to give a 14.3% solids dispersion. To this alumina dispersion (1600 g), the poly (vinyl butyral) BH-6 (146 g of a 10 wt % solution in 3A-alcohol) was added to give a formulation with 6% by weight of poly(vinyl butyral). The hydroxyl terminated PDMS was added at 10 parts DMS-S12 (24.34 g). The solution was Netsch milled for 3 h, followed by filtration through a 10 micron Pall filter. The solution was divided into 6 parts and to one part (272 g) an additional 2% BH-6 (7.6 g of a 10 wt % solution in 3A-alcohol) was added, and an additional 6% DMS-S12 (2.3 g). The solution was coated onto a PET support as described for Example 1 above.

Example 6

6 parts hydroxy terminated PDMS added to 90 wt % gamma-alumina and 10 wt % poly(vinyl butyral) binder. Gamma-alumina (100 g), 3 A alcohol (400 g), and 1.8 mm zirconia beads (1600 g) was placed in a 32 oz. jar and roll milled for 4 days. The alumina was collected by filtering off the shot and rinsing with 3A-alcohol (200 g) and pumped through a 40 micron Pall™ filter to give a 14.3% solids dispersion. To this alumina dispersion (653 g), the poly(vinyl butyral) BH-6/B-72 $(4/1)_{wt}$, (104 g of a 10 wt % solution in 3A-alcohol) was added to give a formulation with 10% by weight of poly(vinyl butyral). Hydroxy-terminated PDMS was added at 6 parts DMS-S12 (6.22 g). The solution was Netsch milled for 1 h, followed by filtration through a 10 micron Pall filter. The solution was divided into 6 parts and to one part (272 g) an additional 2% BH-6 (7.6 g of a 10 wt % solution in 3A-alcohol) was added, and an additional 6 parts DMS-S12 (2.3 g). The solution was coated onto a PET support as described for Example 1 above.

Example 7

PDMS overcoat on gamma-alumina/poly(vinyl butyral)/PDMS. PDMS (10,000 centistoke) was coated on top of Example 6 from a 10 wt % solution in 2-butanone.

Example 8

PDMS overcoat on gamma-alumina/poly(vinyl butyral)/PDMS. DMS-S12 (16-32 centistoke) was coated on top of Example 6 from a 5 wt % solution in 2-butanone.

Example 9

10 parts hydroxy terminated PDMS added to 90 parts gamma-alumina and 10 parts poly(vinyl butyral) binder and overcoated with PDMS. Gamma-alumina (250 g), 3 A alcohol (1000 g), and 2.0 mm zirconia beads (5000 g) was placed in a 1 gallon jar and roll milled for 5 days. The alumina was collected by filtering off the shot and rinsing with 3A-alcohol (500 g) and pumped through a 40 micron Pall® filter to give a 14.3% solids dispersion. To this alumina dispersion (1655 g), the poly(vinyl butyral) BH-6 (263 g of a 10 wt % solution in 3A-alcohol) was added to give a formulation with 10% by weight of poly(vinyl butyral). Hydroxy-terminated PDMS was added at 10 parts DMS-S12 (26.30 g). The solution was Netsch milled for 3 h, followed by filtration through a 10 micron Pall filter. The solution was coated onto a PET support as described for Example 1 above and overcoated with PDMS (10,000 centistoke) from a 5 wt % solution in 2-butanone.

Table 1 below compares the silicone oil absorption and the resistivity of a coating on PET made with pseudo-boehmite/PVA/Zonyl-FSN™ (Comparative Example 1), a coating on PET made with pseudo-boehmite overcoated with WE-6 wax (Comparative Example 2), the NexPress 2100 PET Transport Web (Comparative Example 3), and gamma-alumina/poly(vinyl butyral) (Examples 1 and 2). The pseudo-boehmite coating in Comparative Example 1 has 90 wt % pseudo-boehmite, 10 wt % poly(vinyl alcohol), 6 parts Zonyl FSN. The wax overcoat of WE-6 in Comparative Example 2 was overcoated onto pseudo-boehmite/PVA, the wax overcoat of WE-5 in Examples 3 and 4 were overcoated onto gamma-alumina/poly(vinyl butyral). The gamma-alumina formulation has 90 wt % gamma alumina and 10 wt % poly(vinyl butyral). The table shows that the silicone oil absorption is generally higher for the gamma-alumina layers, and the surface resistivity is also high. All of the samples were transparent. The wax overcoats showed a higher resistivity at high humidity.

Examples 5-9 contain some form of PDMS. They were milled with the dihydroxy terminated PDMS. Examples 5, 7, and 8 were overcoated with PDMS. The addition of the PDMS increased the resistivity of the coating, and small amounts resulted in increased oil absorption.

TABLE 1

Oil Capacity and Surface Resistivity γ-alumina/poly(vinyl butryal) Coatings

| Example | Aim Coverage microns | Thickness microns | Oil Capacity mg/sq m | Specific Capacity mg/sq m/micron | Surface Resistivity (° F./% RH) 70/30 | Surface Resistivity (° F./% RH) 70/60 |
|---|---|---|---|---|---|---|
| Comparative 1 | 30 | 20.0 | 4760 | 238.0 | 1.4E+11 | 7.0E+09 |
| Comparative 2 | 15 | 8.78 | 2160 | 246 | 1.9E+12 | 1.2E+12 |
| 1 | 10 | 8.38 | 3180 | 380 | 7.2E+13 | 5.2E+11 |
| 2 | 15 | 13.24 | 5770 | 436 | 3.9E+13 | 2.8E+11 |
| 3 | 10 | 8.38 | 3800 | 454 | 3.0E+13 | 5.1E+12 |
| 4 | 10 | 8.38 | 3650 | 436 | 4.2E+13 | 5.7E+12 |
| 5 | 10 | 9.19 | 2740 | 298 | >1E+15 | >1E+15 |
| 6 | 10 | 10.27 | 4490 | 437 | >1E+15 | 8.7E+13 |
| 7 | 10 | 10.00 | 5100 | 510 | >1E+15 | 2.5E+14 |
| 8 | 10 | 9.73 | 5230 | 537 | >1E+15 | 9.8E+14 |
| 9 | 10 | 8.92 | 4680 | 525 | >1E+15 | >1E+15 |

The alumina coatings were made into transport belts for a NexPress 2100 Printer by ultrasonically welding the coating into a loop with the coating on the outside. The seams of the sealed belts were coated with either high molecular weight PDMS (100,000 centistoke) or Zonyl-FSN to act as lubricants over the seams for the cleaning blades.

Transport webs Examples 1, 5 and 9 and Comparative Examples 1, 2 and 3 were placed into a NexPress 2100 printer for testing as paper transport webs. The results are summarized in Tables 2 and 3, where the testing was done at the environments of 70 F/50% RH and 80 F/70% RH, respectively. The tackdown of the uncoated web at the lower humidity was assigned a reading of 10 in the tack down test, which is done by sliding the paper off the web after the web is stopped for 10 sec. For this test, all of the readings for the uncoated web (Comparative Example 3) were 10. The good tack down of the receivers to the uncoated NexPress web is probably due to the high surface resistivity of greater than $10^{14}$ ohm/sq. The web material is PET (poly(ethylene terephthalate)). However, all of these pseudo-boehmite overcoats had much better oil absorption than the uncoated NexPress transport web. Residual fuser oil on the uncoated transport web results in unwanted image artifacts on the prints. Two porous webs prepared using pseudo-boehmite with poly(vinyl alcohol) binder were also tested for comparison with gamma-alumina/poly(vinyl butyral) coated web. The pseudo-boehmite coated web Comparative Example 1 that contained 6 parts Zonyl FSN had the poorest tack down and the largest voltage decay after 30 seconds. The pseudo-boehmite coated Comparative Example 2 web that was overcoated with WE-6 wax had better tack down and more voltage remaining after 30 seconds. However the tackdown was poor at high humidity. The coated web that used gamma-alumina as the porous material, Example 1, had substantially better tackdown than either of the webs made using pseudo-boehmite. The data in Table 1 indicate that coating the porous layer with wax should increase the resistivity, and the tackdown should improve further. This is observed in Tables 2 and 3.

Examples 5 and 9 show that the tack down and electrical performance is improved so much by the addition of the PDMS that they are virtually identical to the bare PET (Comparative Example 3). Additionally the PDMS lowers the surface energy of the gamma-alumina coatings making removal of the toner easy and efficient, enabling good cleaning of the web with a blade cleaner.

TABLE 2

Receiver Pull Force and Electrical Decay at 70° F./50% RH

| | | | Paper Tack down Force after 10 sec (1 = worst, 10 = best) | | | Post-Tack down Web Voltage (Decay) | |
|---|---|---|---|---|---|---|---|
| Example | Coating Number | Description of Coating | 60 g uncoated | 118 g coated | 270 coated | After 30 sec | Δ Volts |
| Comparative 3 | NexPress Transport Web | No Coating (PET) | 10 | 10 | 10 | −720 | 0 |
| Comparative 1 | CX8150-2 | pseudo-boehmite + 6 parts Zonyl-FSN | 1 | 5 | 5 | −200 | +440 |
| Comparative 2 | RC5-9560-4 | 0.75 micron WE-6 wax over pseudo-boehmite | 2 | 10 | 10 | −1400 | −540 |
| Example 1 | RC5-9714-5 | Gamma-alumina | 6 | 10 | 10 | −1580 | −420 |
| Example 5 | 9772-10 | Gamma-alumina + PDMS | 10 | 10 | 10 | −940 | 0 |
| Example 9 | 9782-8 | Gamma-alumina + PDMS | 10 | 10 | 10 | −960 | 0 |

TABLE 3

Receiver Pull Force and Electrical Decay at 80° F./70% RH

| | | | Paper Tack down Force after 10 sec (1 = worst, 10 = best) | | | Post-Tack down Web Voltage (Decay) | |
|---|---|---|---|---|---|---|---|
| Example | Coating Number | Description of Coating | 60 g uncoated | 118 g coated | 270 coated | After 30 sec | Δ Volts |
| Comparative 3 | NexPress Transport Web | No Coating (PET) | 10 | 10 | 10 | −860 | 0 |
| Comparative 1 | CX8150-2 | pseudo-boehmite + 6 parts Zonyl-FSN | 1 | 3 | 1 | −100 | +840 |
| Comparative 2 | RC5-9560-4 | 0.75 micron WE-6 wax over pseudo-behmite | 1 | 3 | 1 | −580 | +340 |

TABLE 3-continued

Receiver Pull Force and Electrical Decay at 80° F./70% RH

| Example | Coating Number | Description of Coating | Paper Tack down Force after 10 sec (1 = worst, 10 = best) 60 g uncoated | 118 g coated | 270 coated | Post-Tack down Web Voltage (Decay) After 30 sec | Δ Volts |
|---|---|---|---|---|---|---|---|
| Example 1 | RC5-9714-5 | Gamma-alumina | 5 | 9 | 6 | −1040 | −240 |
| Example 5 | 9772-10 | Gamma-alumina + PDMS | 10 | 10 | 9 | −960 | 0 |

The invention claimed is:

1. An electrostatographic reproduction apparatus comprising:

a primary imaging member for producing an electrostatic latent image;

a development station for applying toner particles to said latent image, thereby forming a developed toner image;

a fuser assembly for fixing said developed toner image to a receiver, thereby forming a fused toner image on said receiver;

an endless transport member for transporting said receiver to or from said fuser assembly, said transport member comprising a substrate bearing an oil-absorbing layer that comprises transparent gamma-aluminum particles dispersed in an organic binder.

2. The electrostatographic reproduction apparatus of claim 1, wherein the transport member further comprises a wax having a melting point less the 100° C.

3. The electrostatographic reproduction apparatus of claim 2, wherein the wax comprises a solid fatty acid ester wax.

4. The electrostatographic reproduction apparatus of claim 2, wherein the transport member has a surface resistivity equal to or greater than $1\times10^{12}$ ohm/sq at 70° F./60% RH.

5. The electrostatographic reproduction apparatus of claim 1, wherein said transparent gamma-aluminum particles have an average dispersed particle size of less than 0.5 microns.

6. The electrostatographic reproduction apparatus of claim 1, wherein said transparent gamma-aluminum particles have an average dispersed particle size of less than 0.3 microns.

7. The electrostatographic reproduction apparatus of claim 1, wherein said transparent gamma-aluminum particles have an average dispersed particle size of less than 0.1 microns.

8. The electrostatographic reproduction apparatus of claim 1, wherein said transparent gamma-aluminum particles have a crystallite size of about 100 angstroms or less based x-ray line broadening analysis of the gamma alumina (440) peak.

9. The electrostatographic reproduction apparatus of claim 1, wherein said organic binder is selected from the group consisting of poly(vinyl alcohol) or a modification product thereof, cellulose derivatives, ether-substituted poly(phosphazenes), ether-substituted acrylates, ethylene oxide-vinyl alcohol copolymers, poly(vinyl butyral), poly(vinyl formal), polyoxazolines, aliphatic polyamides, poly(vinylpyrrolidone), and mixtures thereof.

10. The electrostatographic reproduction apparatus of claim 1, wherein the organic binder is poly(vinyl butyral).

11. The electrostatographic reproduction apparatus of claim 1, wherein said oil-absorbing layer comprises transparent gamma-alumina particles and poly(vinyl butyral) in a weight ratio of about 3:1 to about 20:1.

12. The electrostatographic reproduction apparatus of claim 1, wherein said substrate bearing said oil-absorbing layer is selected from the group consisting of a continuous web loop, a drum, and a roller.

13. The electrostatographic reproduction apparatus of claim 1, wherein said oil-absorbing layer further comprises polydimethylsiloxane.

14. The electrostatographic reproduction apparatus of claim 13, wherein the transport member has a surface resistivity equal to or greater than $1\times10^{13}$ ohm/sq at 70° F./60% RH.

15. The electrostatographic reproduction apparatus of claim 1, wherein said oil-absorbing layer further comprises hydroxy terminated polydimethylsiloxane.

16. The electrostatographic reproduction apparatus of claim 1, wherein said development station comprises a plurality of separate developing devices to enable full color image reproduction.

17. The electrostatographic reproduction apparatus of claim 1, wherein said transport member is adapted for duplex printing.

18. The electrostatographic reproduction apparatus of claim 1, wherein said oil-absorbing layer further comprises a crosslinking agent.

19. The electrostatographic reproduction apparatus of claim 1, wherein said transport member comprises a polyethylene terephthalate.

20. The electrostatographic reproduction apparatus of claim 1, further comprising an intermediate image transfer member operationally associated with the primary image-forming member for transferring the developed toner image from the primary imaging member to the receiver.

21. An electrostatographic reproduction apparatus comprising:

a primary imaging member for producing an electrostatic latent image;

a development station for applying toner particles to said latent image, thereby forming a developed toner image;

a fuser assembly for fixing said developed toner image to a receiver, thereby forming a fused toner image on said receiver;

an endless transport member for transporting said receiver to or from said fuser assembly, said transport member comprising a substrate bearing an oil-absorbing layer that comprises transparent gamma-aluminum particles dispersed in an organic binder wherein the transport member has a surface resistivity equal to or greater than $1\times10^{11}$ ohm/sq at 70° F./60% RH.

* * * * *